US007326134B2

(12) United States Patent
Collucci

(10) Patent No.: US 7,326,134 B2
(45) Date of Patent: Feb. 5, 2008

(54) DEVICE TO CONTROL A SWINGING IMPLEMENT AND METHOD OF USE

(75) Inventor: Vito Collucci, Clifton, NJ (US)

(73) Assignee: VL Enterprises, LLC, Clifton, NJ (US)

( * ) Notice: Subject to any disclaimer, the term of this patent is extended or adjusted under 35 U.S.C. 154(b) by 0 days.

(21) Appl. No.: 11/259,668

(22) Filed: Oct. 26, 2005

(65) Prior Publication Data

US 2007/0093309 A1 Apr. 26, 2007

(51) Int. Cl.
*A63B 49/00* (2006.01)

(52) U.S. Cl. ..... 473/553; 473/551

(58) Field of Classification Search ..... 473/205, 473/206, 551, 553, 458, 464; 81/489, 177.1, 81/177.3; 280/819, 821, 822; 215/396; 463/47.2

See application file for complete search history.

(56) References Cited

U.S. PATENT DOCUMENTS

| | | | | |
|---|---|---|---|---|
| 742,004 | A | 10/1903 | Carnegie | |
| 855,016 | A | 5/1907 | Orthwein | |
| 1,536,211 | A | 5/1925 | Gregory | |
| 2,094,417 | A | 9/1937 | Strohbach | |
| 2,234,638 | A | 3/1941 | Topping | |
| 2,476,489 | A | 7/1949 | Grandinetti | |
| 2,780,464 | A | 2/1957 | Ashley | |
| 3,554,554 | A | 1/1971 | Zane | |
| 3,944,226 | A * | 3/1976 | Starrett | 463/47.2 |
| 3,995,872 | A * | 12/1976 | Joseph | 280/822 |
| 4,355,804 | A * | 10/1982 | Bingham | 463/47.6 |
| 4,591,156 | A * | 5/1986 | Attenni | 473/551 |
| 4,684,559 | A * | 8/1987 | Wasko | 428/100 |
| 4,962,929 | A * | 10/1990 | Melton, Jr. | 473/516 |
| 5,082,156 | A * | 1/1992 | Braun | 224/220 |
| 5,163,685 | A | 11/1992 | Rhodes | |
| 5,320,354 | A | 6/1994 | Vasquez | |
| 5,390,928 | A | 2/1995 | Salini | |
| 5,472,190 | A * | 12/1995 | Norling | 473/463 |
| 5,797,814 | A * | 8/1998 | Janes et al. | 473/551 |
| 5,938,532 | A * | 8/1999 | Wall | 463/47.2 |
| 6,299,557 | B1 * | 10/2001 | Mueller | 473/553 |
| 6,350,206 | B1 | 2/2002 | Lambert, II | |
| 6,719,639 | B2 | 4/2004 | Novosel, Sr. | |
| 6,916,104 | B2 * | 7/2005 | Parsons et al. | 362/191 |

* cited by examiner

*Primary Examiner*—Raleigh W. Chiu
(74) *Attorney, Agent, or Firm*—Mandel & Peslak, LLC; Arthur M. Peslak, Esq.

(57) ABSTRACT

What is disclosed is a device for assisting a person using a golf club, tennis racket or other swinging sports implement to maintain control of the implement during the swing. The device is a strap or other similar device that is to connect the implement and the user's fingers.

9 Claims, 5 Drawing Sheets

DEVICE TO CONTROL A SWINGING IMPLEMENT AND METHOD OF USE

BACKGROUND OF THE INVENTION

The present invention relates to a device that attaches to a golf club, tennis racket or other similar sporting implement to allow a user to better control the club or racket during the swing. Many people enjoy golf or racket sports. However, as people age, they may begin to suffer from arthritis or other problems that may prevent them from gripping and controlling the club or racket properly. As such, an object of the present invention is to provide a device that will aid users in maintaining control of the club or racket. However, the application of the device is not limited to users with medical conditions but will be of assistance to anyone needing a device to control a golf club or racket. In addition, it is also contemplated that the present invention can be used in connection with hand tools such as a hammer, to maintain control over the tool during a swing.

SUMMARY OF THE INVENTION

The present invention is directed to a device that is attached to a swinging implement to control the implement during use. The embodiment disclosed herein is comprised of an elongated strap formed into a loop and connected to a circular clip or tie strap. The clip or tie strap is intended to be attached to the handle of the swinging implement.

DETAILED DESCRIPTION OF THE INVENTION

Figure 1:
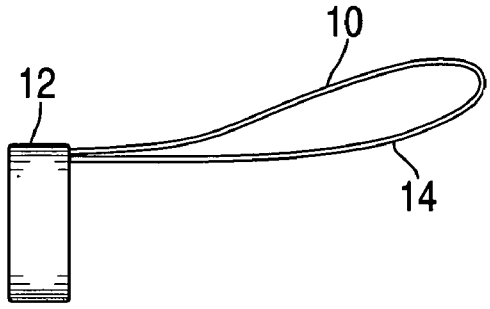
FIG. 1 is a front plan view of an embodiment of the present invention.
Figure 2:
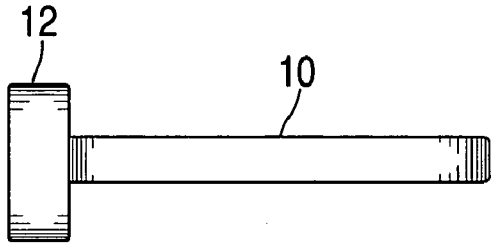
FIG. 2 is an alternative front plan view of an embodiment of the present invention.

The present invention will now be described in terms of the presently preferred embodiments as illustrated in the drawings. However, those of ordinary skill in the art will recognize that many obvious modifications may be made thereto without departing from the spirit or scope of the present invention.

As shown in FIG. 1, the present invention is directed to a strap 10 in the form of a loop. The strap 10 can be fabricated from nylon or other similar materials. The clip or tie strap 12 is threaded through a strap 10 to form the device.

Figure 3:
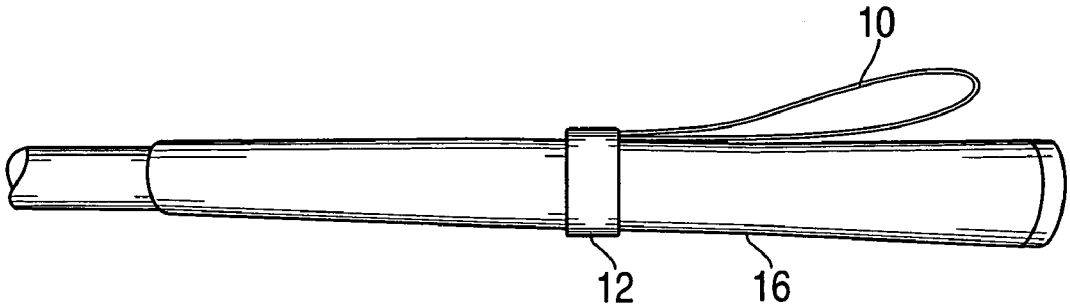
FIG. 3 is a front plan view illustrating an embodiment of the present invention as applied to a golf club.

The installation of the strap 10 on a golf club 16 is illustrated in FIG. 3. As shown in FIG. 3, the clip or tie strap 12 is placed over the handle of the golf club 16 and tightened thereon. The exact placement of the clip or tie strap 12 will be determined by a user's placement of his or her hands on the golf club 16.

Figure 4:
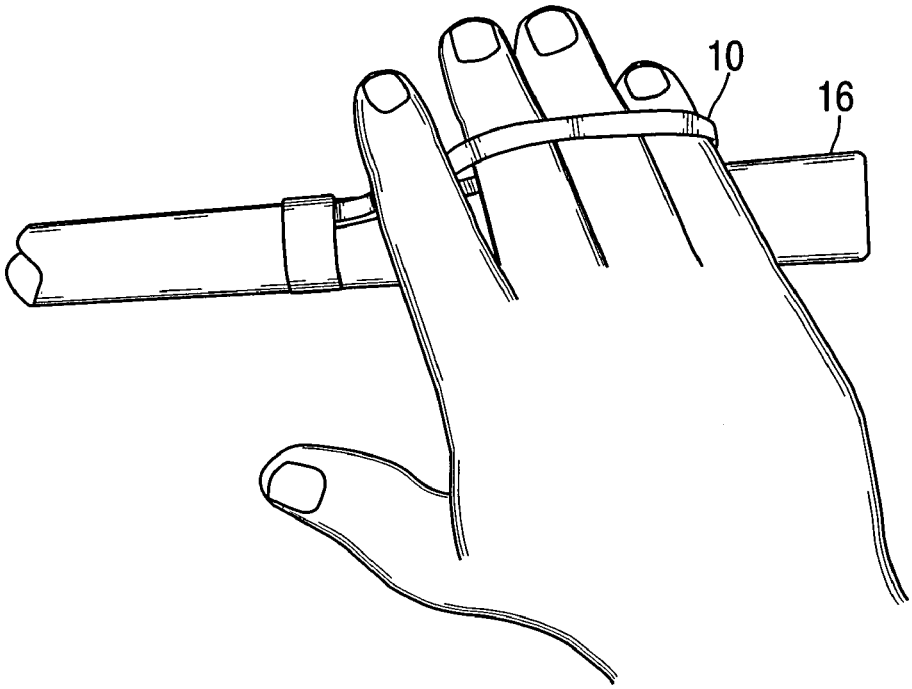
FIG. 4 is a plan view illustrating the use of an embodiment of the present invention in connection with a golf club.
Figure 5:
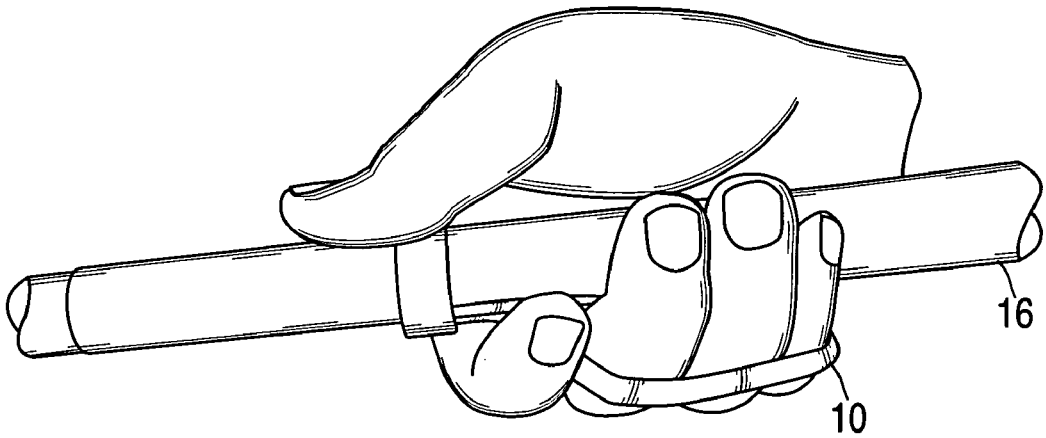
FIG. 5 is a plan view illustrating the use of an embodiment of the present invention in connection with a golf club.
Figure 6:
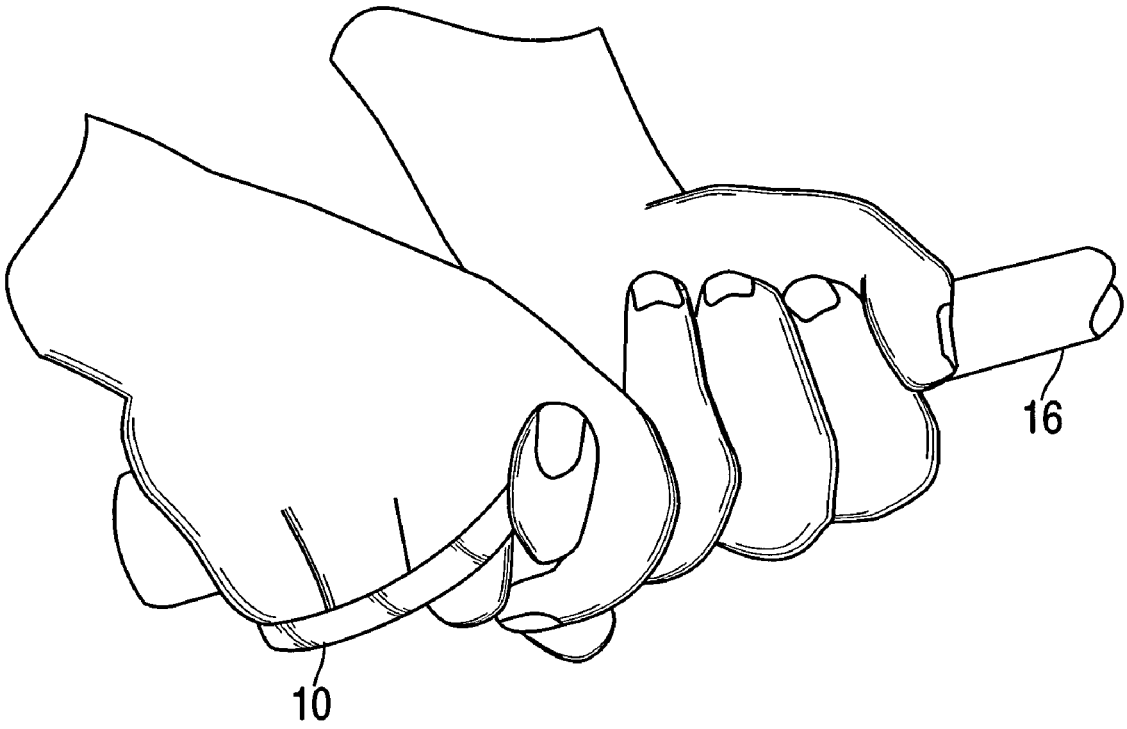
FIG. 6 is a plan view illustrating the use of an embodiment of the present invention in connection with a golf club.

FIGS. 4, 5 and 6 illustrate the use of the strap 10 on a golf club 16. As shown, the strap 10 is used in conjunction with the user's lead hand on the golf club 16. The user begins by placing two or three fingers in the loop 14 with the index finger outside the larger loop 14. The user then grips the club as shown in FIGS. 5 and 6. The user will then swing the golf club 16 normally. In the follow-through of the swing, the strap 10 will help the user maintain control of the golf club 16 by providing a means to retain the golf club 16 in the user's hand. In this way, the user will not have the golf club 16 flying out of his or her hand and potentially injuring someone or damaging the club.

Figure 7:
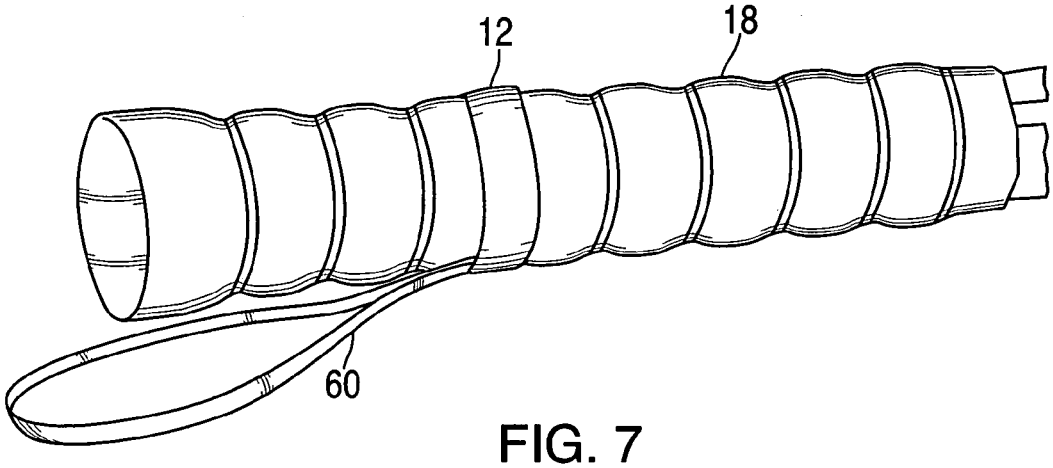
FIG. 7 is a plan view illustrating the use of an embodiment of the present invention in connection with a tennis racket.
Figure 8:
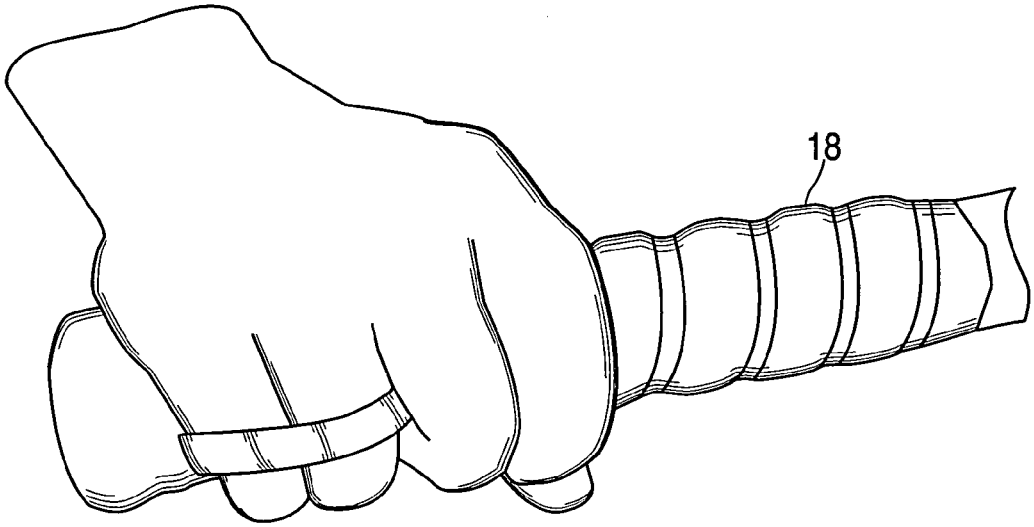
FIG. 8 is a plan view illustrating the use of an embodiment of the present invention in connection with a tennis racket.
Figure 9:
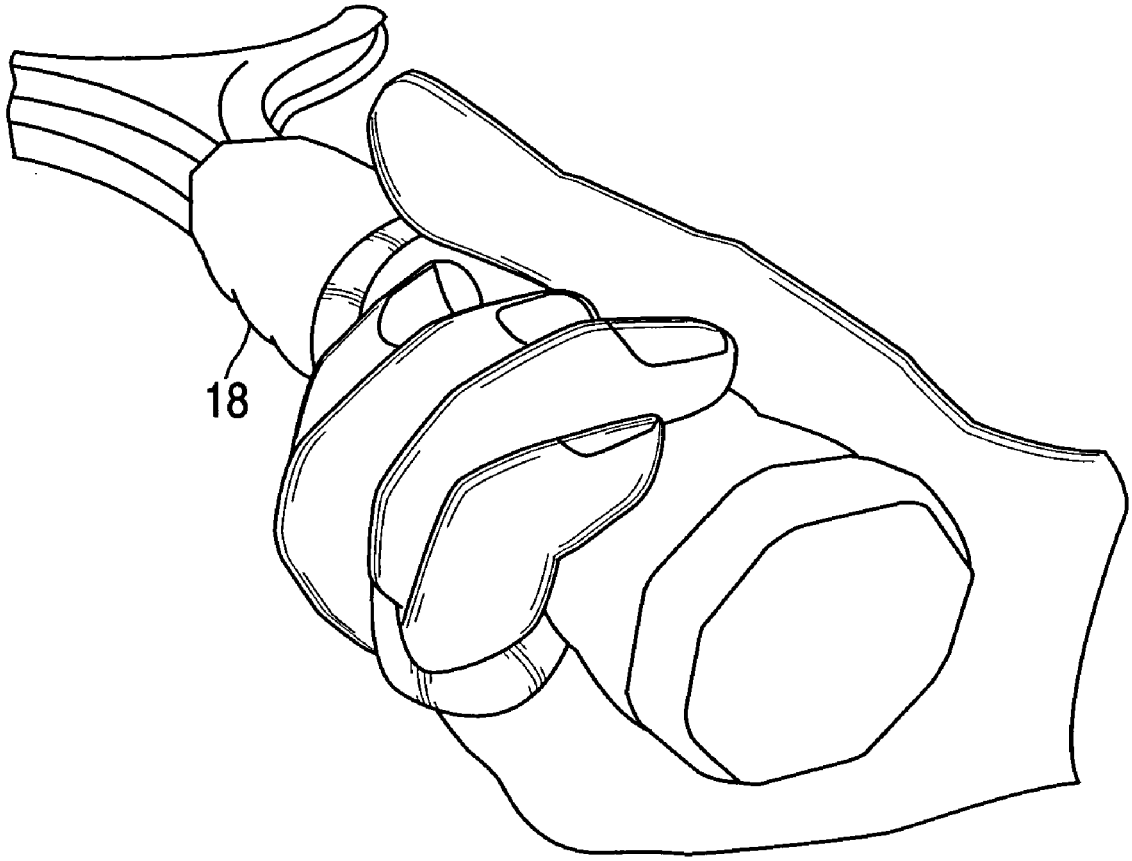
FIG. 9 is a plan view illustrating the use of an embodiment of the present invention in connection with a tennis racket.

The strap 10 can also be used in conjunction with a tennis racket 18 as illustrated in FIGS. 7, 8 and 9. As shown in those Figures, the concepts of applying the strap 10 to a racket 18 is very similar to the use of the present invention in connection with a golf club. As with the golf club, using the strap 10 with the present invention will allow the user to maintain better control over the racket during follow through. It is also contemplated that the strap 10 could be used in conjunction with rackets for other sports such as racquetball or squash. It is also contemplated that the present invention could be similarly applied to a hand tool such as a hammer.

Those of ordinary skill in the art will recognize the foregoing merely illustrates an embodiment of the present invention and many modifications may be made thereto without departing from the spirit or scope of the present invention as set forth in the claims.

What is claimed is:

1. A device for assisting a user to control a swinging implement comprising an elongated handle comprising:

c. An elongated flexible strap formed into a loop wherein the loop is adapted to receive a plurality of the user's fingers when gripping the swinging implement; and d. A circular clip or tie strap connected to the elongated strap wherein the circular clip or tie strap is removably connected directly to a point located a distance from the end of the elongated handle of the swinging implement selected by a user of the swinging implement to allow a comfortable grip.

2. The device of claim 1 wherein the swinging implement is a golf club.

3. The device of claim 1 wherein the swinging implement is a tennis racket or other sports racket.

4. The device of claim 1 wherein the swinging implement is a hand tool.

5. A controllable swinging implement combination comprising:

a. A swinging implement comprising an elongated handle;

b. An elongated flexible strap formed into a loop wherein the loop is adapted to receive a plurality of the user's fingers when griping the swinging implement; and c. A circular clip or tie strap connected to the elongated strap wherein the circular clip is removably connected directly the swinging implement to a point located a distance from the end of the elongated handle of the swinging implement selected by a user of the swinging implement to allow for a comfortable grip and whereby the elongated strap is utilized to control the swinging implement during use.

6. A method for controlling a swinging implement comprising an elongated handle comprising the steps of:

a. Providing the swinging implement;

b. Attaching a device for controlling the swinging implement to the swinging implement comprising:

i. An elongated flexible strap formed into a loop wherein the loop is adapted to receive a plurality of the user's fingers when griping the swinging implement; and ii. A circular clip or tie strap connected to the elongated strap wherein the circular clip or tie strap is removably connected directly to a point located a distance from the end of the elongated handle of the swinging implement selected by the user of the swinging implement to allow for a comfortable grip, c. Gripping the swinging implement by inserting fingers on a hand of the user into the loop, and d. Swinging the implement.

7. The method of claim 6 wherein the swinging implement is a golf club.

8. The method of claim 6 wherein the swinging implement is a tennis racket or other sport racket.

9. The method of claim 6 wherein the swinging implement is a hand tool.

* * * * *